US005232578A

United States Patent [19]

Gillespie

[11] Patent Number: 5,232,578

[45] Date of Patent: Aug. 3, 1993

[54] MULTIBED HYDROCRACKING PROCESS UTILIZING BEDS WITH DISPARATE PARTICLE SIZES AND HYDROGENATING METALS CONTENTS

[75] Inventor: William D. Gillespie, Stafford, Tex.

[73] Assignee: Shell Oil Company, Houston, Tex.

[21] Appl. No.: 682,180

[22] Filed: Apr. 9, 1991

[51] Int. Cl.[5] ..... C10G 65/10; C10G 47/02

[52] U.S. Cl. ..... 208/59; 208/111; 208/112

[58] Field of Search ..... 208/59, 111, 112

[56] References Cited

U.S. PATENT DOCUMENTS

| | | | |
|---|---|---|---|
| 3,293,192 | 12/1966 | Maher et al. | 252/430 |
| 3,449,070 | 6/1969 | McDaniel et al. | 23/111 |
| 3,607,091 | 9/1971 | Boyd | 208/59 |
| 3,702,818 | 11/1972 | Streed et al. | 208/89 |
| 4,370,219 | 1/1983 | Miller | 208/61 |
| 4,797,195 | 1/1989 | Kukes et al. | 208/59 |
| 4,797,196 | 1/1989 | Kukes et al. | 208/59 |
| 4,834,865 | 5/1989 | Kukes et al. | 208/59 |
| 4,959,140 | 9/1990 | Kukes et al. | 208/59 |

FOREIGN PATENT DOCUMENTS

| | | |
|---|---|---|
| 0310164 | 4/1989 | European Pat. Off. . |
| 0310165 | 4/1989 | European Pat. Off. . |
| 1191958 | 5/1970 | United Kingdom . |

*Primary Examiner*—Theodore Morris
*Assistant Examiner*—Walter D. Griffin

[57] ABSTRACT

The operation of a multibed second stage hydrocracker is improved by using in the first or top bed a Group VIB and/or Group VIII metals supported hydrocracking catalyst with at least one of the Group VIB and/or Group VIII components having a metals content on a gram equivalent weight basis, of 1.5 times or greater and an average effective diameter of 0.75 times or less than that of the Group VIB and/or Group VIII metals supported catalyst used in the remaining beds.

21 Claims, No Drawings

MULTIBED HYDROCRACKING PROCESS UTILIZING BEDS WITH DISPARATE PARTICLE SIZES AND HYDROGENATING METALS CONTENTS

FIELD OF THE INVENTION

This invention relates to an improved petroleum hydrocracking process.

BACKGROUND OF THE INVENTION

There are a large number of processes for hydrocracking petroleum hydrocarbon feedstocks and numerous catalysts that are used in these processes. Many of these processes comprise two stages, a feed preparation stage and a hydrocracking stage, the two stages operating with different catalysts. The first stage, in general, contains a hydrodenitrogenation/hydrodesulfurization catalyst which also may include a hydrocracking function for mild hydrocracking and the second stage contains a hydrocracking catalyst. Product from the first stage may be treated to remove ammonia and hydrogen sulfide gases prior to being passed to the second stage, or product may be passed directly to the second stage. In this two stage operation, the hydrocracking stage is frequently referred to as a second stage hydrocracker.

Multiple beds in a hydrocracker have been disclosed in U.S. Pat. Nos. 4,797,195; 4,797,196 and 4,834,865. The latter patent also discloses the use of two different sizes of catalyst in a hydrocracker.

Hydrocracking catalysts generally comprise a hydrogenation component on an acidic cracking support. More specifically, hydrocracking catalysts comprise one or more hydrogenation components selected from the group consisting of Group VIB metals and Group VIII metals of the Periodic Table of the Elements, their oxides or sulfides. The prior art has also taught that these hydrocracking catalysts preferably contain an acidic support comprising a large pore crystalline molecular sieve, particularly an aluminosilicate. These molecular sieves are generally suspended in a refractory inorganic oxide binder such as silica, alumina, or silica-alumina. The oxides such as silica, silica-alumina and alumina have also been used alone as the support for the hydrogenating metals for certain specific operations.

Regarding the hydrogenation component, the preferred Group VIB metals are tungsten and molybdenum and the preferred Group VIII metals are nickel and cobalt. The prior art has also taught that combinations of metals for the hydrogenation component in the order of preference are: Ni-W, Ni-Mo, Co-Mo and Co-W. Other hydrogenation components broadly taught by the prior art include iron, ruthenium, rhodium, palladium, osmium, iridium and platinum. Among these latter components, platinum and/or palladium are particularly preferred with palladium being most preferred.

Hydrocracking is a general term which is applied to petroleum refining processes wherein hydrocarbon feedstocks which have relatively high molecular weights are converted to lower molecular weight hydrocarbons at elevated temperature and pressure in the presence of a hydrocracking catalyst and a hydrogen-containing gas. Hydrogen is consumed in the cracking of the high molecular weight compounds to lower molecular weight compounds. Hydrogen will also be consumed in the conversion of any organic nitrogen and sulfur compound to ammonia and hydrogen sulfide as well as in the saturation of olefins and other unsaturated compounds. The hydrocracking reaction is exothermic and when substantially adiabatic reactors are used, as is usually the case, the temperature in the catalyst bed will rise progressively from the beginning to the end of the reactor. Excessive temperature in the reactor can present several problems. High temperatures can damage the catalyst, can result in the safe operating temperature of the reactor being exceeded or can cause the hydrocracking reaction to "run away", with disastrous results. This temperature rise problem can be solved by dividing the catalyst in the reactor into a series of beds with interstage cooling supplied between the beds by the injection of a cooled hydrogen-containing gas stream.

When the multiple bed configuration is used in a second stage hydrocracker, optimum use of the catalyst requires that each bed do a proportionate amount of the hydroconversion. For example in the common five bed second stage hydrocracker each bed should carry out about twenty percent of the hydroconversion, resulting in a temperature rise in each of the beds of about the same degree. It has been found, however, that in many cases the catalyst in the first bed is somehow inhibited such that its activity is less than that of the catalyst in the remaining beds. As a result, the first bed carries out less than its proportionate share of hydroconversion, thus resulting in a smaller temperature rise in the first bed than occurs in the remaining beds. Raising the temperature of the feed to the first bed can increase conversion, but can also require excessive cooling between the first and second bed which will result in an inefficient utilization of hydrogen. Further, if the physical configuration of the reactor limits the amount of hydrogen that can be injected between the beds or limits the temperature to which the top bed can be heated, then the top bed can not be operated at its full hydroconversion potential. It has been found that by modifying the catalyst in the first bed over that in the remaining beds pursuant to the teachings of the instant invention by providing it with higher hydrogenation metals content and smaller particle size, the conversion in the first bed can be raised to the level in the remaining beds, resulting in a more efficient operation.

SUMMARY OF THE INVENTION

This invention relates to an improvement in a process for hydrocracking a hydrocarbon feedstock having components boiling above 375° F. by reacting said hydrocarbon feedstock with added hydrogen in the presence of a hydrocracking catalyst comprising one or more hydrogenating components selected from the group consisting of Group VIB metals, oxides, sulfides, Group VIII metals, oxides, sulfides and mixtures thereof and a carrier having hydrocracking activity under hydrocracking conditions in a reactor comprising at least two separate beds of said catalyst stacked on top of each other which process comprises (a) providing the feedstock and a hydrogen-containing gas to the top bed, (b) passing the reaction product of each bed directly to the next bed, (c) providing interbed cooling by admixing a hydrogen-containing gas having a temperature less than the hydrocracking temperature with the reaction product passing between each bed and (d) removing a hydrocracked product from the bottom bed;

the improvement which comprises using in one or more of the top beds which comprises up to fifty percent by volume of the catalyst used in the reactor a catalyst which contains about 1.5 times or greater the gram atom content per gram of total catalyst of at least one of the Group VIB and Group VIII hydrogenating components (basis the metal) and which has a average effective pellet diameter of about 0.75 or less of that of the average effective pellet diameter of the catalyst used in the remaining beds. Preferred hydrogenating Group VIB components are tungsten and molybdenum. Preferred hydrogenating Group VIII components are nickel and cobalt and it is preferred that this be the component in the top bed which is 1.5 times the amount in the remaining beds. Preferred carriers for the hydrogenating metal components are the wide pore molecular sieves with pores greater than about 6 angstroms combined with a binder selected from alumina, silica and silica-alumina, particularly zeolite Y combined with alumina.

DESCRIPTION OF THE PREFERRED EMBODIMENTS

The instant invention is a method for improving the operation of a multibed second stage hydrocracking reactor by using in one or more of the top beds which comprise up to about fifty percent by volume of the catalyst used in the reactor a supported hydrocracking catalyst which contains 1.5 times or greater the gram atom content per gram of total catalyst of Group VIB metal and/or 1.5 times or greater the gram atom content per gram of total catalyst of Group VIII metal and which has an average effective diameter of about 0.75 or less of the average effective diameter of the catalyst used in the remaining beds.

The use herein of terminology similar to "one or more of the top beds which comprise up to fifty percent by volume of the catalyst used in the reactor" refers to the top bed and optionally the next bed or beds in series, without skipping, up to the point wherein the beds contain up to but not exceeding fifty percent by volume of the catalyst used in the reactor. For example, in a six bed reactor with catalyst equally disposed throughout the beds, "one or more of the top beds" will include (a) the top bed. (b) the top bed plus the second (from the top) bed and (c) the top bed plus the second bed plus the third (from the top) bed, but will not include the first bed and third bed (skipping the second bed). The top beds will thus be in contiguous series. The catalyst arranged in the aforementioned top beds will be referred herein as the "top bed catalyst". The catalyst arranged in the remaining beds will be referred herein as the "bottom bed catalyst".

The feedstock for the process comprises a heavy oil fraction having a major proportion, say, greater than about fifty percent, of its components boiling above about 375° F., preferably above about 425° F. or higher. Suitable feedstocks of this type include gas oils such as atmospheric and vacuum gas oil and coker gas oil, visbreaker oil, deasphalted oil, catalytic or thermal cracker cycle oil, synthetic gas oils, coker products and coal liquids. Normally the feedstock will have an extended boiling range, e.g., up to 1100° F. or higher, but may be of more limited ranges with certain feedstocks. In general terms, the feedstocks will have a boiling range between about 300° F. and about 1200° F. Typically the feedstock has been first subjected to a hydroprocessing step prior to hydrocracking to remove nitrogen, sulfur and heavy metal impurities. this hydroprocessing step may also provide some degree of hydrocracking. The hydroprocessed feedstock may be passed directly to the hydrocracker, or it may be processed to remove ammonia, hydrogen sulfide and possibly lower boiling fractions prior to being passed to the hydrocracker.

Operating conditions to be used in the hydrocracking reaction zone include an average catalyst bed temperature within the range of about 400° F. to about 1000° F., preferably about 500° F. to about 900° F., and most preferably about 550° F. to about 800° F., a liquid hourly space velocity (LHSV) of about 0.1 to about 10 volumes of liquid hydrocarbon per hour per volume of catalyst, preferably a LHSV of about 0.5 to about 5, and a total pressure within the range of about 500 psig to about 5000 psig, a hydrogen partial pressure within the range of about 475 psig and about 4500 psig, and a hydrogen circulation rate of about 500 to about 20.000 standard cubic feet per barrel (SCF/BBL).

The second stage hydrocracking reactor comprises a vertical reactor having from two to about 6 beds of catalyst. Between the beds are placed means for injecting a hydrogen-containing stream into the reactor. This hydrogen-containing stream is cooler than the reactor, say, by about 100° F. or more, and serves to cool the process stream as it passes from one bed to the one below. The hydrogen-containing stream may be pure hydrogen or may be admixed with other gases. Typically it is derived from hydrogen-rich processing streams such as those from hydrocarbon dehydrogenation reactors such as catalytic reformers or may be produced via steam-methane reforming. The hydrogen-containing stream is provided to each of the beds in amounts sufficient to maintain an excess of hydrogen throughout the reactor. The hydrocarbon feedstock is heated to reactor temperature prior to being fed to the top bed. Typically, a hydrogen-containing stream is mixed with the feedstock and the mixture is heated to reaction temperature, although the hydrogen-containing stream may be fed separately to the top bed.

The catalysts used in the second stage hydrocracker comprise metals, oxides and/or sulfides of Group VIB and/or Group VIII elements of the Periodic Table supported on a porous support having hydrocracking activity. The key aspect of this invention is that the top bed catalyst will have a metals content higher and an effective diameter lower than that of the catalyst used in the remaining beds. The metals content of at least one of the hydrogenating components of the top bed catalyst will be about 1.5, preferably about 2 times greater than the corresponding metals content of the catalyst in the remaining beds when considered as the metal in terms of gram atoms per gram of total catalyst. In general the metals content of the top bed catalyst will range from about 1.5 to about 3, preferably from about 1.5 to about 2.5 times the metals content of the remaining beds when considered as the metal in terms of gram atoms per gram of total catalyst. While reference is made herein to the "metals content" of the catalyst, it is understood that this is for measurement reference purposes and that the metal can be in other forms such as the oxide or sulfide. The gram atom per gram of total catalyst is determined by measuring the weight of metal in a gram of catalyst and dividing by the atomic weight of the metal. It is preferred that the catalysts in the beds other than the top bed, i.e., "the remaining beds", be substantially the same. However, it is contemplated that the remaining beds may individually contain catalysts that differ in metals content and average effective diameter, in which case reference to the metals content and average effective diameter of the catalyst in the remaining beds will refer to the maximum metals content and maximum average effective diameter of the catalysts used in the remaining beds.

In general when reference is made herein to the metals content of one or more hydrogenating components selected from Group VIB and Group VIII in the top bed(s) being greater than the content in the remaining bed(s), it is meant that the component in both the top and remaining or bottom beds will be the same component, that is, if the component is platinum in the bottom beds, then platinum will be in the top bed(s) in an increased amount. However, those with skill in the hydrocracking art recognize that certain metals in Group VIB and Group VIII can be interchanged to provide comparable results. It is recognized in Group VIB that molybdenum and tungsten can be interchanged and in Group VIII that nickel and cobalt can be interchanged with each other and platinum and palladium can be interchanged with each other if their respective atomic weights are factored in. Thus, the instant specification and accompanying claims, as appropriate, will recognize this equivalency and include the partial or complete substitution of molybdenum for tungsten (and vice versa), cobalt for nickel (and vice versa) and platinum for palladium (and vice versa) in the catalysts used in the top and bottom bed(s).

The average effective diameter of the top bed catalyst pellets will be about 0.75 times or less than that of the average effective pellet diameter of the catalyst pellets used in the remaining beds. In general the average effective diameter of the top bed catalyst pellets will range from about 0.75 times to about 0.25 times the average effective pellet diameter of the the catalyst pellets used in the remaining beds. Preferably, the pellet shapes used in the instant invention will be either cylinders or polylobes or both. The polylobed pellets will have from two to about five lobes. Trilobes are preferred for use in the top bed. The effective diameter of a pellet is defined as the diameter of a sphere with the same surface to volume ratio (S/V) as the pellet and can be calculated as 6 times V/S. Average effective pellet diameters of catalyst used in the remaining beds will generally range from about 0.05 to about 0.2 inches. Cylinders are preferably used in the remaining beds.

The active metals component, "the hydrogenating component", of the hydrocracking catalyst is selected from a Group VIB and/or a Group VIII metal component. From Group VIB molybdenum, tungsten and mixtures thereof are preferred. From Group VIII there are two preferred classed: 1) cobalt, nickel and mixtures thereof and 2) platinum, palladium and mixtures thereof. Preferably both Group VIB and Group VIII metals are present. In a particularly preferred embodiment the hydrogenating component is nickel and/or cobalt combined with tungsten and/or molybdenum with nickel/tungsten being particularly preferred. The components are typically present in the oxide or sulfide form. In general the amounts of Group VIB and Group VIII metals present in the catalyst in the beds other than the top bed (the remaining beds) are set out below on an elemental basis and based on the total catalyst weight.

| | Broad | Preferred | Most Preferred |
|---|---|---|---|
| Group VIB | 1–30 | 1–20 | 2–15 |
| Group VIII | 0.05–10 | 0.1–5 | 0.2–3.5 |
| Nickel | 1–10 | 1–5 | 1.5–3.5 |
| Cobalt | 1–6 | 1–5 | 1.5–4 |
| Tungsten | 1–30 | 2–20 | 4–15 |
| Molybdenum | 1–20 | 1–15 | 2–10 |
| Platinum | 0.05–5 | 0.1–2 | 0.2–1 |
| Palladium | 0.05–5 | 0.1–2 | 0.2–1 |

The Group VIB and Group VIII metals are supported on a carrier having hydrocracking activity. Two main classes of carriers known in the art typically utilize: (a) the porous inorganic oxide carriers selected from alumina, silica, alumina-silica and mixtures thereof and (b) the the large pore molecular sieves. Mixtures of the inorganic oxide carriers and the molecular sieves are also used. The term "silica-alumina" refers to non-zeolitic aluminosilicates.

Preferred supports are the large pore molecular sieves admixed with an inorganic oxide binder selected from the group consisting of alumina, silica, silica-alumina and mixtures thereof. The molecular sieves have pores greater than about 6 angstroms, preferably between about 6 to about 12 angstroms. Suitable wide pore molecular sieves are described in the book *Zeolite Molecular Sieves* by Donald W. Breck, Robert E. Krieger Publishing Co., Malabar, Fla., 1984. Suitable wide pore molecular sieves comprise the crystalline aluminosilicates, the crystalline aluminophosphates, the crystalline silicoaluminophosphates and the crystalline borosilicates. Preferred are the crystalline aluminosilicates or zeolites. The zeolites are preferably selected from the group consisting of faujasite-type and mordenite-type zeolites. Suitable examples of the faujasite-type zeolites include zeolite Y and zeolite X. Other large pore zeolites such as zeolites L, beta and omega also be used alone on in combination with the more preferred zeolites.

The most preferred support comprises a zeolite Y, preferably an ultrastable zeolite Y (zeolite USY). The ultrastable zeolites used herein are well known to those skilled in the art. They are also exemplified in U.S. Pat. Nos. 3,293,192 and 3,449,070. They are available commercially from W. R. Grace & Co. and from Union Carbide Corp. They are generally prepared from sodium zeolite Y by using one or more ammonium ion exchanges followed by steam calcination. They can further be subjected to a so-called dealumination technique to reduce the amount of alumina present in the system. Dealumination techniques are described extensively in the art and comprise inter alia the use of acid extraction, the use of silicon halides or other suitable chemical treating agents, chelates as well as the use of chlorine or chlorine-containing gases at high temperatures. They will typically have low sodium contents of less than about 1 percent and will have unit cell sizes ranging from about 24.20 to about 24.60 angstroms.

The zeolite is composited with an binder selected from alumina, silica, silica-alumina and mixtures thereof. Preferably the binder is an alumina binder, preferably a gamma alumina binder or a precursor thereto, such as an alumina hydrogel, aluminum trihydroxide or aluminum oxyhydroxide.

Two classes of zeolite-containing supports are typically used: (a) those containing a small amount of zeolite and a large amount of "binder", that is, alumina, silica, silica-alumina and mixtures thereof and (b) large amounts of zeolite and small amounts of binder.

The low zeolite-containing support will contain from about 1 to about 50, preferably from about 1 to about 25, and more preferably from about 1 to about 10 percent by weight of molecular sieve on a calcined (dehydrated) basis of molecular sieve plus binder with the balance being composed of binder.

The high zeolite-containing support will contain from about 50 to about 99, preferably from about 60 to about 95, and more preferably from about 70 to about 90 percent by weight of molecular sieve on a calcined (dehydrated) basis of molecular sieve plus binder with the balance being composed of binder.

The catalysts are prepared by traditional methods. For example, the molecular sieve and binder in the form of a hydrogel or hydrosol may by mulled together with water and an optional peptizing agent, extruded into pellets and calcined. The calcined pellets are impregnated with one or more solutions containing solubilized salts of Group VIB and Group VIII elements. Alternatively, the hydrogenating components may be mulled into the zeolite/alumina mixture prior to calcining. Impregnation and mulling may be combined as method for incorporating the hydrogenating components.

The catalysts are normally presulfided prior to use. Typically, the catalysts are presulfided by heating in hydrogen sulfide/hydrogen atmosphere (e.g.. 5% v $H_2S$/95% v $H_2$) at elevated temperatures, say about 700° F. for several hours, e.g. 1–4 hours. Other methods are also suitable for presulfiding and generally comprise heating the catalysts to elevated temperatures (e.g., 400°–750° F.) in the presence of hydrogen and sulfur or a sulfur-containing material.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

ILLUSTRATIVE EMBODIMENTS

In a commercial second stage hydrocracker having five beds of nickel-tungsten/zeolite USY-alumina catalyst in the shape of ⅛ inch cylinders it was found that the catalyst in the first or top bed was about 15°–20° F. less active than the catalyst in the lower beds. The reactor normally operates at a LHSV of about 1.2 hour$^{-1}$ to provide a conversion the feed boiling above 375° F. of about 60%. The conversion is calculated from the formula:

$$[\%375^\circ F.^+(feed) - \%375^\circ F.^+(product)] \times 100/\%375^\circ F.^+(feed)$$

To model the second stage hydrocracker, a laboratory system was set up. This comprised a 0.75 inch I.D. reactor with a 0.25 inch thermowell running through the center of the entire length of the 9.5 inch catalyst bed. To prepare the reactor, 20 cc of catalyst were diluted with about 63 grams of 60×80 mesh silicon carbide and loaded into the reactor in four equally sized aliquots.

Catalyst was presulfided in the laboratory reactor by a programmed heating to 700° F. in 5% v/95% v $H_2S/H_2$ gas mixture flowing at about 100 l/hr.

To model the full length hydrocracker (full bed), feed was provided to the reactor at a LHSV of 1.2 and the temperature was adjusted to provide a conversion of 60%. To model only the top bed of a five bed reactor, feed was provided to the reactor at a LHSV of 6 and the temperature was adjusted to give a conversion of 1/5 of the conversion in the full length reactor or 12%. The temperature of the reactor is a measure of the activity of the catalyst. The more active catalyst can be operated at a lower temperature than a less active catalyst while providing the same conversion.

The laboratory reactor conditions were:

| | | |
|---|---|---|
| Reactor inlet pressure | 1500 | psig |
| LHSV | 1.2* or 6.0** | hr$^{-1}$ |
| hydrogen/oil ratio | 6500 | SCF/BBL |
| Conversion of 375° F.+ | 60%* or 12%** | |

(*for full bed modeling;
**for top bed modeling)

The feed used was a typical second stage hydrocracker feed fed to a commercial unit, containing recycle and was obtained while the hydrocracker was in the turbine fuel mode of operation. The corresponding first stage feed was about 65% CCLGO with the remainder being atmospheric gas oil. The properties of the feed was as follows:

| | |
|---|---|
| CARBON (WT %) | 87.71 |
| HYDROGEN (WT %) | 12.21 |
| SULFUR (PPM) | 29 |
| NITROGEN (PPM) | 14 |
| DENSITY (G/CC @ 60° F.) | 0.896 |
| UV AROMATICS (WT % AROMATIC CARBONS) | |
| BENZENES | 12.9 |
| NAPHTHALENES | 2.9 |
| PHENANTHRENES | 1.0 |
| TETRA | 0.4 |
| TOTAL | 17.2 |

TBP-GC

| WT % FF | DEG F. | DEG C. |
|---|---|---|
| 10 | 446 | 230 |
| 20 | 480 | 249 |
| 30 | 507 | 264 |
| 40 | 534 | 279 |
| 50 | 561 | 294 |
| 60 | 588 | 309 |
| 70 | 616 | 324 |
| 80 | 650 | 343 |
| 90 | 695 | 368 |
| 98 | 760 | 404 |

The reactor was run for about 22 days to obtain stability and the temperature of the reactor was recorded. As a reference catalyst was used a catalyst containing about 3% wt. Ni and 9% wt W on a support made up of 80& wt zeolite USY and 20% wt alumina and made in the form of ⅛ inch cylinders. This catalyst is denoted Catalyst A in the table below. Other catalysts with differing sizes and differing amount of catalyst metals compared to the reference catalyst were tested and the activities in the form of reactor temperatures are indicated in the last two columns in the table below.

| CATALYST | TYPE | EFFECTIVE DIAMETER INCHES | METALS | TOP BED SIMULATION* | FULL BED SIMULATION** |
|---|---|---|---|---|---|
| A | 1/8 cyl | 0.147 | reference | 357° C. | 345° C. |
| B | 1/16 cyl | 0.077 | reference | 350° C. | 343° C. |
| C | 1/16 cyl | 0.077 | 2X Ni<br>1X W | 344° C. | |
| D | 1/16 cyl | 0.077 | 2X Ni<br>2X W | 346° C. | |
| E | 1/16 cyl | 0.077 | 1.5X Ni<br>1.5X W | 347° C. | |
| F | 1/10 trilobe | 0.094 | 2X Ni<br>1X W | 346° C. | |
| G | 1/16 trilobe | 0.062 | 2X Ni<br>1X W | 342° C. | |
| H | 1/10 trilobe | 0.094 | 2.5X Ni<br>1.5X W | 341° C. | |

*LHSV of 6.0 $hr^{-1}$ and a conversion of 375° F.$^+$ material of 12%
**LHSV of 1.2 $hr^{-1}$ and a conversion of 375° F.$^+$ material of 60%

As can be seen from the above data the reference catalyst A showed an activity loss in the top bed of about 12° C. which would make it difficult to balance out the conversion across a five bed second stage hydrocracker. Catalyst B, which has a smaller diameter, still has an activity problem. Simultaneously reducing the diameter and increasing the metals content provides a catalyst that solves the top bed problem.

What is claimed is:

1. In a process for hydrocracking a hydrocarbon feedstock having components boiling above 375° F. by reacting said hydrocarbon feedstock with added hydrogen in the presence of a hydrocracking catalyst comprising one or more hydrogenating components selected from the group consisting of Group VIB metals, oxides, sulfides, Group VIII metals, oxides, sulfides and mixtures thereof and a zeolite Y carrier having hydrocracking activity under hydrocracking conditions in a reactor comprising at least two separate beds of said catalyst stacked on top of each other which process comprises (a) providing the feedstock and a hydrogen-containing gas to the top bed, (b) passing the reaction product of each bed directly to the next bed, (c) providing interbed cooling by admixing a hydrogen-containing gas having a temperature less than the hydrocracking temperature with the reaction product passing between each bed and (d) removing a hydrocracked product from the bottom bed;

the improvement which comprises using in one or more of the top beds which comprise up to fifty percent by volume of the catalyst used in the reactor a catalyst which contains about 1.5 times or greater the gram atom content per gram of total catalyst of at least one of the Group VIB and Group VIII hydrogenating components (basis the metal) and which has an average effective pellet diameter of 0.75 times or less the average effective pellet diameter of the catalyst used in the remaining beds.

2. The process of claim 1 wherein in the catalyst the Group VIB component is selected from tungsten, molybdenum and mixtures thereof, the Group VIII component is selected from nickel, cobalt and mixtures thereof and the zeolite Y carrier is admixed with a binder selected from an inorganic oxide selected from alumina, silica, silica-alumina and mixtures thereof.

3. The process of claim 2 wherein the Group VIII component is nickel, the Group VIB component is selected from molybdenum, tungsten and mixtures thereof and the binder is alumina.

4. The process of claim 3 wherein the Group VIB component is tungsten.

5. The process of claim 4 wherein the catalyst used in the remaining beds has a nickel content ranging from about 1 to about 5 percent by weight of the total catalyst, a tungsten content ranging from about 2 to about 20 percent by weight of the total catalyst, a zeolite content ranging from about 50 to about 99 percent by weight, basis zeolite plus alumina and an average effective pellet diameter ranging from about 0.05 to about 0.2 inches.

6. The process of claim 5 wherein the zeolite is an ultrastable zeolite Y having a unit cell size ranging from about 24.20 to about 24.60 angstroms.

7. The process of claim 6 wherein the catalyst in the one or more of the top beds has a nickel content of about 1.5 to about 3.5 times the nickel content of the catalyst used in the remaining beds and an average effective pellet diameter between about 0.25 and about 0.75 of the average effective pellet diameter of the catalyst used in the remaining beds.

8. The process of claim 7 wherein the catalyst used in the remaining beds has a tungsten content of about 4 to about 15 percent by weight of the total catalyst and a nickel content of about 0.2 to about 3.5 percent by weight of the total catalyst.

9. The process of claim 1 wherein the reactor has six beds.

10. The process of claim 1 wherein the reactor has five beds.

11. The process of claim 1 wherein the one or more top beds is the top bed and the next from the top bed.

12. The process of claim 1 wherein the one or more top beds is the top bed only.

13. The process of claim 1 wherein the catalyst in the one or more of the top beds has the shape of a trilobe and the catalyst in the remaining beds has the shape of a cylinder.

14. The process of claim 1 wherein the hydrogenating component in the remaining beds Group VIII and is present in an amount (basis metal) ranging from about 0.05 to about 10 percent based on the total catalyst weight.

15. The process of claim 14 wherein the hydrogenating component is selected from platinum, palladium and mixtures thereof and is present in an amount ranging from about 0.05 to about 5 percent based on the total weight of the catalyst.

16. The process of claim 1 wherein the hydrogenating component in the remaining beds a mixture of Group VIII which is present in an amount (basis metal) ranging from about 0.2 to about 3.5 percent based on the total catalyst weight and Group VIB which is present in an amount (basis metal) ranging from about 2 to about 15 percent based on the total catalyst weight.

17. The process of claim 1 wherein the process operates at a temperature ranging from about 600° to about 900° F., a pressure ranging from about 500 to about 5000 psig, an LHSV of about 0.1 to about 10 and the total hydrogen fed to the process ranges from about 500 to about 20.000 standard cubic feet of hydrogen per barrel of feedstock.

18. In a process for hydrocracking a hydrocarbon feedstock having components boiling above 375° F. by reacting said hydrocarbon feedstock with added hydrogen at a temperature ranging from about 600° to about 900° F., a pressure ranging from about 500 to about 5000 psig, an LHSV of about 0.1 to about 10 and a hydrogen feed to the process ranging from about 500 to about 20,000 standard cubic feed of hydrogen per barrel of feedstock in the presence of a hydrocracking catalyst comprising a Group VIII hydrogenating component selected from the group consisting of nickel metal, oxide, sulfide, cobalt metal, oxide, sulfide and mixtures thereof and a Group VIB hydrogenating component selected from the group consisting of tungsten metal, tungsten oxide, tungsten sulfide, molybdenum metal, molybdenum oxide, molybdenum sulfide and mixtures thereof and a carrier comprising an ultra stable zeolite Y having a unit cell size ranging from about 24.20 to about 24.60 angstroms and a binder comprising alumina in a reactor comprising five separate beds of said catalyst stacked on top of each other which process comprises (a) providing the feedstock and a hydrogen-containing gas to the top bed,
(b) passing the reaction product of each bed directly to the next bed,
(c) providing interbed cooling by admixing a hydrogen-containing gas having a temperature less than the hydrocracking temperature with the reaction product passing between each bed and
(d) removing a hydrocracked product from the bottom bed;

the improvement which comprises using in the top bed a catalyst which contains the same hydrogenating components as in the remaining beds and which contains about 1.5 times or greater the gram atom content per gram of total catalyst of at least one of the Group VIB and Group VIII hydrogenating components (basis the metal) and which has an average effective pellet diameter of 0.75 times or less the average effective pellet diameter of the catalyst used in the remaining beds and wherein the catalyst in the remaining beds has a Group VIB content, basis metals, of about 2 to about 15 percent by weight of the total catalyst, a Group VIII content, basis metals, of about 0.2 to about 3.5 percent by weight of the total catalyst, a zeolite content ranging from about 70 to about 90 percent by weight, basis zeolite plus alumina and an average effective pellet diameter ranging from about 0.05 to about 0.2 inches.

19. The process of claim 18 wherein the catalyst in the top bed contains about 1.5 times or greater the gram atom content per gram of total catalyst of the Group VIII hydrogenating component (basis the metal).

20. The process of claim 18 wherein the catalyst in the top bed contains about 1.5 times or greater the gram atom content per gram of total catalyst of both the Group VIB and Group VIII hydrogenating components (basis the metal).

21. The process of claim 18 wherein the Group VIII component is selected from the group of nickel metal, nickel oxide, nickel sulfide and mixtures thereof and the Group VIB component is selected from tungsten metal, tungsten oxide, tungsten sulfide and mixtures thereof.

* * * * *